US010442202B2

(12) United States Patent
Fukumoto

(10) Patent No.: US 10,442,202 B2
(45) Date of Patent: Oct. 15, 2019

(54) MANUFACTURING METHOD OF BONDED-SUBSTRATE ARTICLE, MANUFACTURING METHOD OF LIQUID DISCHARGE HEAD, BONDED-SUBSTRATE ARTICLE, AND LIQUID DISCHARGE HEAD

(71) Applicant: CANON KABUSHIKI KAISHA, Tokyo (JP)

(72) Inventor: Yoshiyuki Fukumoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/997,366

(22) Filed: Jun. 4, 2018

(65) Prior Publication Data

US 2018/0354267 A1 Dec. 13, 2018

(30) Foreign Application Priority Data

Jun. 9, 2017 (JP) ..... 2017-114250

(51) Int. Cl.
*B41J 2/16* (2006.01)
*B41J 2/14* (2006.01)

(52) U.S. Cl.
CPC ..... *B41J 2/1623* (2013.01); *B41J 2/14233* (2013.01); *B41J 2/1628* (2013.01); *B41J 2/1629* (2013.01); *B41J 2/1631* (2013.01); *B41J 2/1646* (2013.01)

(58) Field of Classification Search
CPC ..... B41J 2/1623; B41J 2/1628; B41J 2/1629; B41J 2/1631; B41J 2/1646; B41J 2/14233
USPC ..... 347/20, 44; 216/20, 33–35
See application file for complete search history.

(56) References Cited

U.S. PATENT DOCUMENTS 5,871,657 A * 2/1999 Nelson ..... B41J 2/1603 216/27
6,406,636 B1 * 6/2002 Vaganov ..... B23K 1/0016 216/2
6,871,942 B2 * 3/2005 Emery ..... B41J 2/14129 347/56
8,460,794 B2 * 6/2013 Zheng ..... B32B 7/03 428/411.1

FOREIGN PATENT DOCUMENTS

JP H09187938 A 7/1997

* cited by examiner

*Primary Examiner* — An H Do
(74) *Attorney, Agent, or Firm* — Canon U.S.A., Inc. IP Division

(57) ABSTRACT

A manufacturing method for a bonded-substrate article includes a first bonding where a first bonding region of a first substrate and a third bonding region of a second substrate are bonded at a first temperature, and a second bonding, following the first bonding, where a second bonding region of the first substrate and a fourth bonding region of the second substrate are bonded at a second temperature. The first temperature is lower than the second temperature.

20 Claims, 5 Drawing Sheets

MANUFACTURING METHOD OF BONDED-SUBSTRATE ARTICLE, MANUFACTURING METHOD OF LIQUID DISCHARGE HEAD, BONDED-SUBSTRATE ARTICLE, AND LIQUID DISCHARGE HEAD

BACKGROUND

Field of the Disclosure

The present disclosure relates to a bonded-substrate article where multiple substrates have been bonded, a manufacturing method of the bonded-substrate article, a liquid discharge head having the bonded-substrate article, and a manufacturing method thereof.

Description of the Related Art

In recent years, devices configured of bonded-substrate articles where substrates have been bonded to each other are being fabricated in functional devices such as microelectromechanical systems (MEMS) like pressure sensors, acceleration sensors, and so forth, microfluidic devices, and so forth. An example thereof is a liquid discharge head that discharges liquid.

A liquid discharge head is a device that has multiple energy generating elements, and causes liquid to be discharged from multiple discharge orifices, by energy provided from the energy generating elements. The liquid discharge head normally has a configuration where multiple substrates are bonded, such as a substrate where energy generating elements and circuits for driving these are formed, a substrate where discharge orifices are formed, a substrate where channels for liquid to be supplied to the discharge orifices are formed, and so forth. It is important in such a configuration that the substrates are bonded to each other with high precision. If the positional relation among the boards is off, this creates variation in volume of the channels and in the relative positional relation between the energy generating elements and discharge orifices, which can lead to unevenness in discharge.

Japanese Patent Laid-Open No. 9-187938 describes a liquid discharge head having a top plate that forms channels for liquid to guide the liquid to discharge orifices, and a substrate where energy generating elements are formed, wherein protrusions formed in the top plate and grooves formed in the substrate are fit one on one, and bonded by an adhesive agent. The bottoms of the grooves provided to the substrate are formed tapered, and accordingly the protrusions formed on the top plate moved along the inclination at the bottoms of the grooves, and thus are positioned in a stable manner. Accordingly, positioning of the top plate and the substrate can be performed with high precision.

In recent years, reduction in size and high density of discharge orifices have come to be demanded of liquid discharge heads. Accordingly, there is demand for positioning of substrates with even higher precision.

Even if substrates are fit to each other with the bottom of grooves tapered, such as described in Japanese Patent Laid-Open No. 9-187938, misalignment may still occur among substrates. This is due to thermal stress on the adhesive agent and substrates, due to heating when hardening the adhesive agent.

SUMMARY

A manufacturing method for a bonded-substrate article, according to the present disclosure, where a first substrate has a first bonding region and a second bonding region that are both bonded to a second substrate, and the second substrate has a third bonding region and a fourth bonding region that are both bonded to the first substrate. The method includes: first bonding, where the first bonding region of the first substrate and the third bonding region of the second substrate are bonded at a first temperature; and second bonding following the first bonding, where the second bonding region of the first substrate and the fourth bonding region of the second substrate are bonded at a second temperature. The first temperature is lower than the second temperature.

Also, a manufacturing method for a liquid discharge head according to the present disclosure is a manufacturing method for a liquid discharge head having a bonded-substrate article where a first substrate has a first bonding region and a second bonding region that are both bonded to a second substrate, and the second substrate has a third bonding region and a fourth bonding region that are both bonded to the first substrate, and the bonded-substrate article has a liquid channel traversing the first substrate and the second substrate. The method includes: first bonding, where the first bonding region of the first substrate and the third bonding region of the second substrate are bonded at a first temperature; and second bonding, following the first bonding, where the second bonding region of the first substrate and the fourth bonding region of the second substrate are bonded at a second temperature. The first temperature is lower than the second temperature.

Further, a liquid discharge head according to the present disclosure is a liquid discharge head having a bonded-substrate article where a first substrate and a second substrate are bonded to each other, and the bonded-substrate article has a liquid channel provided traversing the first substrate and the second substrate. The bonded-substrate article is the bonded-substrate article described above.

Further features of the present disclosure will become apparent from the following description of exemplary embodiments with reference to the attached drawings.

DESCRIPTION OF THE EMBODIMENTS

Figure 1A:
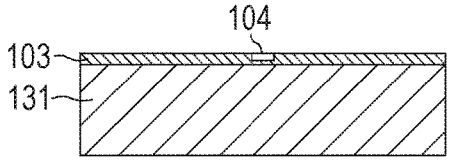
FIGS. 1A through 1I are cross-sectional views illustrating a manufacturing method for a liquid discharge head according to an embodiment of the subject disclosure.

It has been found desirable to provide a manufacturing method of a bonded-substrate article and a manufacturing method of a liquid discharge head, where positioning among substrates can be performed with high precision. It also has been found desirable to provide a bonded-substrate article where boards have been bonded to each other with high precision, and a liquid discharge head having the bonded-substrate article.

The bonded-substrate article according to the present disclosure and the manufacturing method thereof will be described below, by way of example of a liquid discharge head.

First Embodiment

The manufacturing method of the liquid discharge head according to a first embodiment will be described with reference to FIGS. 1A through 2C. FIGS. 1A through 2C are all cross-sectional views of the liquid discharge head, and describe the manufacturing method in order.

Structure of Liquid Discharge Head

First, the structure of the liquid discharge head to which the manufacturing method of the bonded-substrate article and liquid discharge head according to the present embodiment is applied will be described with reference to FIG. 1*i*. The liquid discharge head according to the present embodiment has a bonded-substrate article 130 where a first substrate 131 and a second substrate 132 have been bonded, as illustrated in FIG. 1*i*. An energy generating element 104 that generates energy used to discharge liquid is formed on the first substrate 131 making up the bonded-substrate article 130. Also formed on the first substrate 131 are a surface membrane layer 103 that includes a wiring film for driving the energy generating element 104 and an inter-layer insulating film. A discharge orifice forming member 107 that forms a discharge orifice 101 is formed above the bonded-substrate article 130. The discharge orifice forming member 107 is configured including a top plate 105 where the discharge orifice 101 is opened, and a side wall 106 that forms a pressure chamber 102 that communicates with the discharge orifice 101 and is where energy generated from the energy generating element 104 is applied to the liquid. Note that the discharge orifice 101 and pressure chamber 102 can be deemed to be a type of channel.

A channel 115 for liquid is provided to the bonded-substrate article 130, traversing the first substrate 131 and second substrate 132. A film 108 is formed on the inner wall face of the channel 115, traversing the first substrate 131 and second substrate 132. The film 108 is a film that has liquid-resistant properties, and serves to protect the inner wall face of the bonded-substrate article 130 from erosion by the liquid such as ink or the like. The channel 115 is configured of a first channel 112, a second channel 113, and a third channel 114. The first channel 112 comes into contact with the pressure chamber 102 that corresponds to one discharge orifice 101. The second channel 113 comes into contact with multiple first channels 112 within the liquid discharge head, and distributes liquid to the first channels 112. The third channel 114 is connected to the second channel 113, and has a role of narrowing the width of a channel that is externally supplied. In the present embodiment, out of the channel 115, the first channel 112 and second channel 113 are formed in the first substrate 131, and the third channel 114 is formed in the second substrate 132.

The liquid discharge head illustrated in FIG. 1I has two channels 115*a* and 115*b* connected to one pressure chamber 102, and liquid within the pressure chamber 102 can be circulated within and without the pressure chamber 102 via these two channels. The liquid can be made to flow into the pressure chamber 102 from the channel 115*a* at the left side, and flow out from the channel 115*b* at the right side, as indicated by the arrows in FIG. 1*i*. In a case of applying the liquid discharge head according to the present embodiment to an inkjet recording head, for example, thickening of ink in the discharge orifice 101 and pressure chamber 102 can be suppressed by this liquid flow.

Manufacturing Method of Liquid Discharge Head

Next, a manufacturing method of the liquid discharge head according to the present embodiment will be described.

1. Process for Preparing First Substrate and Second Substrate

The first substrate 131 where the energy generating element 104 for generating energy used for discharging liquid and the surface membrane layer 103 have been formed is prepared, as illustrated in FIG. 1A. Examples of the energy generating element 104 include an element such as a heater element that boils ink by heating under application of electricity, and elements that apply pressure to the liquid using volume change, such as a piezoelectric element. The surface membrane layer 103 is made up of a wiring film for driving the energy generating element 104 and an inter-layer insulating film. Note that details such as the wiring, insulating film, transistors, electrode contact pads, and so forth, are omitted from illustration.

Various types of substrates suitable for forming the energy generating element 104 and wiring film can be used as the first substrate 131. The first substrate 131 preferably includes any one selected from a group made up of silicon, silicon carbide, silicon nitride, glass (quartz glass, borosilicate glass, alkali-free glass, soda glass), alumina, gallium arsenide, gallium nitride, aluminum nitride, and aluminum alloy. Out of these, a silicon substrate is suitably used for the first substrate 131. The first substrate 131 worked to reduce thickness from the rear face if necessary. Techniques to reduce thickness include grinding and wet etchings using an etchant such as hydrofluoric acid. The rear face of the first substrate 131 is also subjected to smoothing, to facilitate a bonding process with the second substrate 132, which will be described later. Techniques for smoothing include grinding with a grinding stone of a large grain size, dry polishing, grinding by chemical-mechanical polishing (CMP), dry etching using reactive gas, and wet etchings using an etchant such as hydrofluoric acid.

Figure 1B:
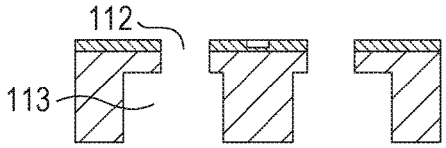

Next, the first channel 112 and second channel 113 are formed in the first substrate 131, as illustrated in FIG. 1B. Techniques for forming channels include dry etching, wet etching, laser etching, and sandblasting. The first substrate 131 is etched partway through from the rear face side, thereby forming the second channel 113 having a groove shape. The first substrate 131 is further etched from the front face side until communicating with the second channel 113 thereby forming multiple hole-shaped first channels 112. The shapes of the first channel 112 and second channel 113 are not restricted to the above-described shapes, and shapes that are optimal for what the device needs can be selected. Also, the order of formation thereof is not restricted, and the second channel 113 may be formed after forming the first channel 112.

Figure 1C:
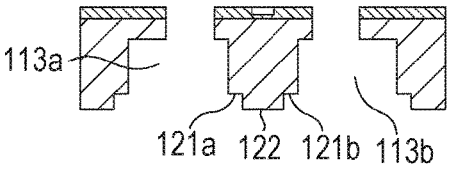

Next, the rear face of the first substrate 131 (the bonding face with the second substrate 132) is worked, to form a first bonding region 121 and a second bonding region 122, as illustrated in FIG. 1C. The first bonding region 121 and second bonding region 122 are provided in order from the inner wall of the second channel 113 in the direction toward the inner portion of the bonded-substrate article 130, and a step is provided between the first bonding region 121 and second bonding region 122. The face where the second bonding region 122 is formed protrudes out further than the face where the first bonding region 121 is formed, in the direction of bonding of the first substrate 131 and second substrate 132. A portion of the first substrate 131 immediately below the energy generating element 104, i.e., the middle portion of the first substrate 131 as illustrated in FIG. 1C, comes into contact with two channels 113*a* and 113*b*, and first bonding regions 121*a* and 121*b* are provided on the bonding face at the respective channel sides. The second bonding region 122 has a protruding form between the two first bonding regions 121*a* and 121*b* at the bonding face at the middle portion. The protruding form fits to a recessed form formed on the front face of the second substrate 132 in a later-described process.

The reason why the bonding face is divided into the first bonding region 121 and second bonding region 122 is for functional separation of the bonding face. That is to say, two-stage bonding is performed in the later-described bonding processing in the present embodiment, so bonding regions corresponding to the bonding processes is preferable. Details of the bonding process will be described later.

The following method can be exemplified for working the bonding face into a protruding form. First, an etching mask is formed on the bonding face of the first substrate 131 where the second channel 113 is to be formed. Laminating and transferring a resist formed into a dry film onto the bonding face is preferable as a technique for forming the etching mask on the bonding face of the first substrate 131, since the etching mask can be formed relatively easily even if there is a large opening such as the third channel 114. An etching mask for forming the step on the bonding face of the first substrate 131 may be formed beforehand, before forming the second channel 113. The material of the etching mask preferably has high thermal stability, and is stable with regard to the working process on the second channel 113. Examples of such a material include resist, an organic resin that is insoluble in stripping solution, and an inorganic film such as a silicon oxide film or a silicon nitride film formed by vapor growth. Thereafter, the substrate is etched over the etching mask, thereby forming the first bonding region 121 and second bonding region 122. Thereafter, the etching mask is removed by a stripping solution, oxygen plasma ashing, dry etching, or some like technique. At this time, the bonded-substrate article may be cleansed using a stripping solution for removing etching deposits, to remove etching deposits adhered to the surface of the inner walls of the channels and the bonding face.

Figure 1D:
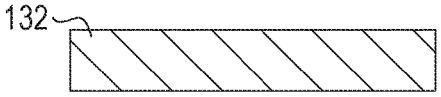
Figure 1E:
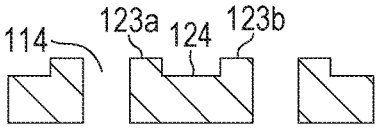

The second substrate 132 is prepared, as illustrated in FIG. 1D. Material the same as that of the first substrate 131 can be used for the second substrate 132. A silicon substrate is suitably used for the second substrate 132. The second substrate 132 can be subjected to reduction in thickness and smoothing, the same way as with the first substrate 131.

Next, the third channel 114 is formed by a technique the same as described above, as illustrated in FIG. 1E. Further, the bonding face with the second substrate 132 is worked to separately form a third bonding region 123 and a fourth bonding region 124, that can fit to the step on the bonding face of the first substrate 131. The third bonding region 123 and fourth bonding region 124 are provided in order from the inner wall of the third channel 114 in the direction toward the inner portion of the bonded-substrate article 130, with a step provided between the third bonding region 123 and fourth bonding region 124, in the same was as with the first substrate 131. The face where the fourth bonding region 124 is formed is at a position more recessed than the face on which the third bonding region 123 is formed, in the direction of bonding the first substrate 131 and second substrate 132. The first substrate 131 and second substrate 132 can be fit to each other by this step. Note that the portion of the bonding face of the second substrate 132 that bonds to the middle portion of the first substrate 131 as illustrated in FIG. 1C, is a recessed form so as to fit to the protruding form of the bonding face of the first substrate 131. That is to say, the fourth bonding region 124 is a recessed form between two third bonding regions 123*a* and 123*b*.

2. Process of Bonding First Substrate and Second Substrate

Next, the first substrate 131 and second substrate 132 are bonded to each other. This bonding includes at least the two processes of a process of bonding the first bonding region 121 of the first substrate 131 and the third bonding region 123 of the second substrate 132 (first bonding process), and following the first bonding process, a process of bonding the second bonding region 122 of the first substrate 131 and the fourth bonding region 124 of the second substrate 132.

The first bonding process is performed to precisely fix the first substrate 131 and second substrate 132 beforehand, before the second bonding process. On the other hand, the second bonding process is performed to strongly bond the substrates to each other, and is performed at a relatively high temperature. If there is not process such as the first bonding process before the second bonding process to fix the substrates to each other, the positions of the substrates will deviate due to thermal stress applied to the substrates in the second bonding process. Thus, the first bonding process where the substrates are fixed to each other at a lower temperature (first temperature) than the temperature of the second bonding process (second temperature) is performed in the present embodiment before the second bonding process. Accordingly, positional deviation among the substrates does not readily occur even through a high-temperature process such as the second bonding process.

Figure 5:
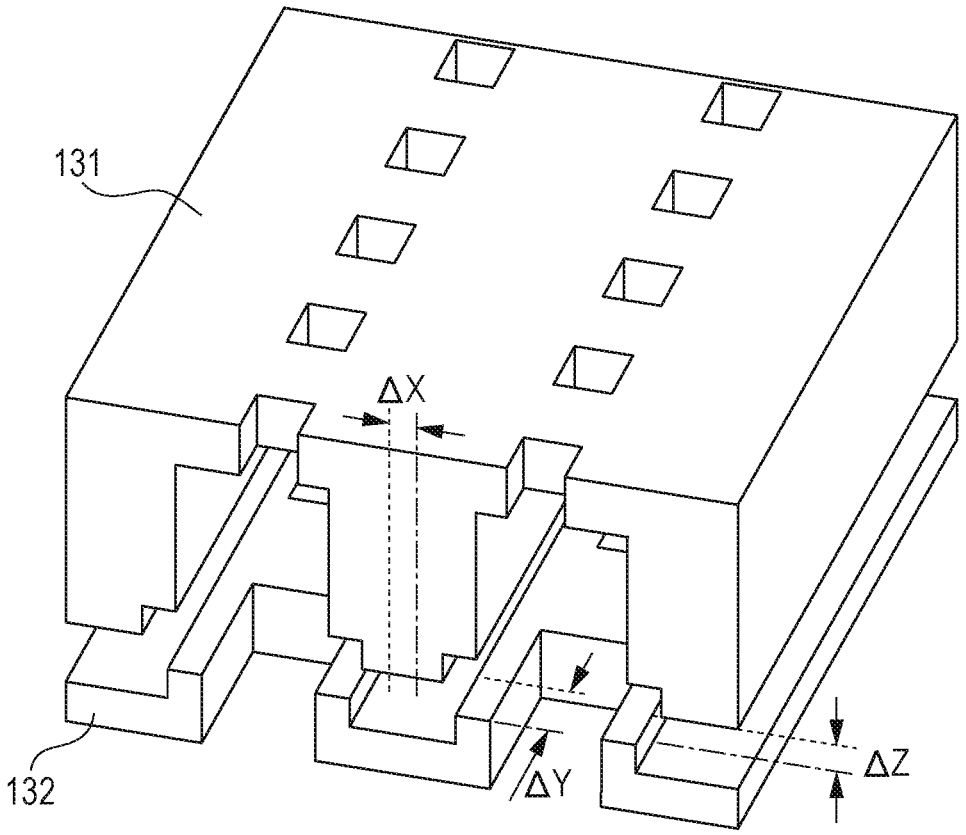
FIG. 5 is a perspective view of a bonded-substrate article, according to one or more embodiments of the subject disclosure.

The first bonding region 121 and third bonding region 123 are bonded by direct bonding in the first embodiment. Direct bonding is normally performed at a low temperature, so there is no thermal stress or the like on the substrates, and the substrates can be quickly and precisely fixed to each other. Also, adhesive agent itself is not used, so positional deviation due to adhesive agent does not occur, and further the two substrates can be quickly and strongly fixed at the instant of contact. FIG. 5 is a perspective view of the first substrate 131 and second substrate 132 before bonding. Direct bonding enables the positional deviation $\Delta X$ and $\Delta Y$ in the horizontal direction of the substrates and positional deviation $\Delta Z$ in the vertical direction of the substrates, illustrated in FIG. 5 to be suppressed to 0.5 μm or less.

In a case where the bonding portions of the substrates are exposed in the channel 115 for liquid, as in the liquid discharge head according to the present embodiment, if the substrates are bonded to each other using adhesive agent, the adhesive agent may be altered by the liquid such as ink, and adhesion strength between the substrates may deteriorate. However, the bonding process according to the present embodiment bonds the first bonding region 121 and third bonding region 123 at the channel 115 side using direct bonding, so contact between liquid and adhesive agent does not readily occur, and deterioration in adhesion between the substrates due to alteration of adhesive agent. Moreover, and advantage is that the adhesion material can be optimized only by bonding capabilities, without having to take into consideration liquid resisting properties when selecting an adhesive agent.

There are several techniques for direct bonding. One example of direct bonding is plasma activated bonding. Plasma activated bonding involves forming hydroxyl groups on each of the bonding faces by plasma irradiation, and bonding the substrates to each other by hydrogen bonding and dehydration condensation reaction among the hydroxyl groups. A second example of direct bonding involves forming hydroxyl groups on each of the bonding faces by oxidizing the bonding faces by an oxidizing liquid such as ozone water or a hydrogen peroxide solution, and bonding the substrates to each other by hydrogen bonding and dehydration condensation reaction among the hydroxyl groups. A third example of direct bonding is room-temperature bonding, where the outermost surfaces of the bonding faces are etched in a vacuum, and thereafter the bonding faces are brought into contact with each other. Note that the third example is advantageous in that a high bonding strength can be obtained at room temperature. Of these, plasma activated bonding and room-temperature bonding are preferable, since bonding can be performed at relatively low temperatures. The processes of bonding the first substrate 131 and second substrate 132 will be described below in order, according to an example of plasma activated bonding.

2-1. Pre-Processing Process

Pre-processing is performed before the first bonding process and second bonding process. The bonding faces are preferably clean and smooth for performing direct bonding. Accordingly, the bonding faces of the first substrate 131 and the bonding faces of the second substrate 132 are preferably cleansed before the first bonding process, to remove foreign matter present on the bonding faces. Smoothing the bonding faces to increase planarity of the bonding faces also is preferable.

An example of a cleaning method is physical cleaning using cleaning by physical shock. Specific examples include megasonic cleaning, two fluid cleaning where liquid is broken by a nitrogen jet, high pressure liquid jet cleaning, and brush scrub cleaning. Examples of liquid used therein include pure water, ozone water, hydrogen water, ammonia water, and hydrogen fluoride water. Another example of cleaning methods is chemical cleaning, where the substrates are dipped in a liquid or the bonding faces of the substrates are coated with a liquid, and cleansing is performed by causing a chemical reaction between the substrates and the liquid. Specific examples of chemical cleaning include a cleaning method using a mixed solution of ammonia and a hydrogen peroxide solution, a cleaning method using a mixed solution of sulfuric acid and a hydrogen peroxide solution, and a cleaning method where hydrogen fluoride water and ozone water are alternately coated.

Examples of techniques for smoothing the bonding faces include grinding with a grinding stone of a fine grain size, dry polishing, polished by CMP, dry etching using reactive gas, and wet etchings using an etchant such as hydrofluoric acid, as described above. The surface roughness of the bonding faces after smoothing preferably is 20 nm or less, and more particularly is 1 nm or less. The term "surface roughness" as used here refers to the arithmetic average roughness (Ra) of a roughness curve stipulated in Japan Industrial Standards (JIS) B0601:2001. Note that the smoothing of the bonding faces may be performed before performing the first bonding process, may be performed immediately before forming the channels in the substrates, or both may be performed.

Thereafter, when performing the direct bonding, pre-processing is executed in accordance with the type of direct bonding. The pre-processing differs according to the type of direct bonding. In the case of pre-processing for plasma activated bonding, at least one bonding face of the first substrate 131 and second substrate 132 is irradiated by plasma formed by discharging using nitrogen gas, oxygen gas, or argon gas, in a vacuum. The plasma-irradiated faces may be cleaned with pure water following plasma irradiation, to increase the number of hydroxyl groups on the bonding faces.

2-2. Process of Coating Adhesive Agent

Figure 1F:
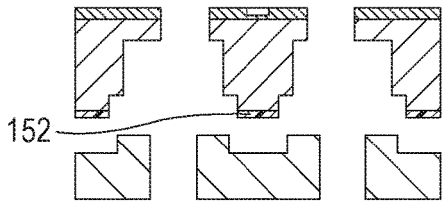
Figure 2A:
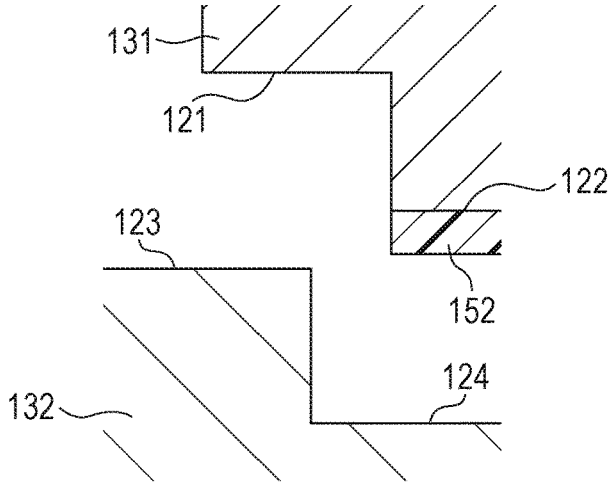
FIGS. 2A through 2C are enlarged cross-sectional views around bonding portions, as part of the manufacturing method for a liquid discharge head according to an embodiment of the subject disclosure.

Next, an adhesive agent 152 is coated on the second bonding region 122 of the first substrate 131, as illustrated in FIGS. 1F and 2A. The adhesive agent 152 is an adhesive agent to be hardened in the later-described second bonding process. Coating the adhesive agent 152 after bonding has been performed in the later-described first bonding process is difficult, so the adhesive agent 152 is coated beforehand, before the first bonding process.

A material that has high adhesion to the substrates is preferably used for the adhesive agent 152. A material that has little inclusion of bubbles and high coatablity is preferable, and a material that has low viscosity, enabling a thinner layer of adhesive agent 152 to be formed, is preferable. The adhesive agent 152 is preferably includes a resin selected from a group made up of acrylic resin, epoxy resin, silicone resin, benzocyclobutene resin, polyamide resin, polyimide resin, and urethane resin. Benzocyclobutene resin is more preferably included, since a high bonding strength for the adhesive agent 152 can be obtained. Examples of the method of hardening the adhesive agent 152 include thermal hardening and retarded UV curing. Note that in a case where either of the substrates is UV-transmissive, fast UV curing can be used.

An example of a technique to coat with the adhesive agent 152 is adhesive agent transfer by substrate. Specifically, a transferring substrate is prepared, and the adhesive agent is thinly and uniformly coated onto the transferring substrate by spin coating or slit coating. Thereafter, the bonding faces of the first substrate 131 are brought into contact with the coated adhesive agent, thereby transferring the adhesive agent onto just the bonding faces of the first substrate 131. The size of the transferring substrate suitably is the same dimensions as the first substrate 131 or larger, and the material suitably is silicon or glass.

It is sufficient for the adhesive agent 152 to be coated on at least one of the second bonding region 122 of the first substrate 131 and the fourth bonding region 124 of the second substrate 132, and may be coated on the fourth bonding region 124 of the second substrate 132 side. In a case of coating the adhesive agent by adhesive agent transfer, the second bonding region 122 of the first substrate 131 side, which is the top face of the protruding portion, is preferably coated, from the perspective of ease of coating.

2-3. First Bonding Process

Figure 1G:
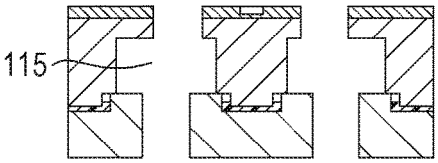
Figure 2B:
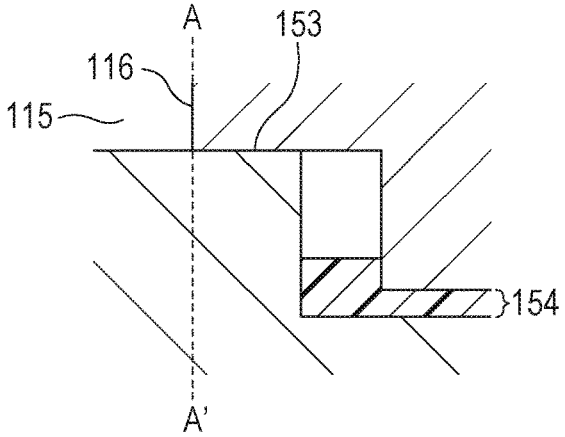

Next, the bonding faces of the substrates are made to face each other, aligned by a bonding alignment device or the like, and the first bonding region 121 of the first substrate 131 and the third bonding region 123 of the second substrate 132 are bonded by direct bonding, as illustrated in FIGS. 1G and 2B.

An example of an alignment method includes a technique of using an optical microscope to align one substrate at a time. First, one substrate is loaded to an alignment device, and adjusted so that alignment marks are in the field of view of the optical microscope. Thereafter, the optical microscope and the one substrate are fixed, and the device is caused to remember the alignment mark positions. Next, another substrate is loaded to the alignment device, and this other substrate is disposed between the one substrate and the optical microscope, with the bonding face of one substrate and the bonding face of the other substrate facing each other.

Positioning is performed while observing using the optical microscope, so that the alignment marks provided on the opposite side of the other substrate from the bonding face matches the alignment mark position of the one substrate. When alignment is completed, the other substrate and the one substrate are fixed, thereby completing alignment. An example of the fixing method is clamping with a clamp jig. When the two substrates are fixed, these are transported to a bonding device along with the jig that is fixing them. In a case where alignment and bonding can be performed in the same device, bonding may be performed in the same device after alignment is completed.

Another example of an alignment method is a technique to bring the substrates into close proximity while facing each other, and position the alignment marks on each using infrared light that that can pass through the substrates, while observing through a microscope. Another method is to prepare two microscopes provided so as to sandwich the two substrates facing each other, and to perform positioning while viewing alignment marks provided on each of the two substrates.

Direct bonding is performed by pressurizing the substrates at room temperature, and bringing the first bonding region 121 and third bonding region 123 into contact. When the bonding faces come into contact, the hydroxyl groups on the bonding faces exhibit hydrogen bonding, and the substrates are fixed to each other. Pressurizing can be performed in a vacuum or in the ambient atmosphere. Note that in order to raise the bonding strength of the bonding portions between the first bonding region 121 and the third bonding region 123, after bonding, thermal processing may be performed at a low temperature where the adhesive agent 152 will not harden, to promote dehydration condensation reaction.

It is sufficient for the temperature in the first bonding process (first temperature) to be lower than the temperature in the second bonding process (second temperature). Specifically, the first temperature preferably is 200° C. or lower, particularly preferably is 150° C. or lower, and further preferably is 50° C. of lower. Although the lower limit of the first temperature is not restricted in particular, 0° C. or higher, and particularly 20° C. or higher is preferable. Note that the temperature referred to here is the temperature of the bonded-substrate article.

2-4. Second Bonding Process

Next, the adhesive agent 152 coated on the second bonding region 122 is hardened, thereby bonding the second bonding region 122 of the first substrate 131 and the fourth bonding region 124 of the second substrate 132. The role of a bonding portion 154 between the second bonding region 122 and the fourth bonding region 124 is to exhibit high bonding strength, and to suppress occurrence of bonding voids and guarantee bonding reliability. Heating at high temperature is performed in the second bonding process, to form such a bonding portion 154. Although the temperature depends on the type of adhesive agent, heating is performed at 100° C. or higher but 300° C. or lower, and more particularly 150° C. or higher but 300° C. or lower. Note that the temperature referred to here is the temperature of the bonded-substrate article.

In a case where the adhesive agent 152 is a thermosetting type, the substrates fixed beforehand by the first bonding process are placed in a bonding device, and after the substrates are heated to a predetermined temperature within the bonding device, the adhesive agent 152 is sufficiently hardened at a predetermined temperature, time, and pressure. The second bonding process is preferably performed while pressurizing. This suppresses thermal expansion when heating and thermal contraction when cooling of the adhesive agent 152 and substrates, thereby suppressing positional device between the substrates even further. Although the hardening reaction may be completed within the bonding device, the substrates may be extracted from the bonding device at a state where the adhesive agent 152 has hardened to a certain extent, and separately heated in an oven. This enables the hardening reaction to be performed in a short time.

In the case that the adhesive agent 152 is a retarded UV curing type, the adhesive agent 152 is irradiated by a stipulated amount of ultraviolet rays before the first bonding process, and the substrates are then further heated in the second bonding process after the first bonding process, to sufficiently harden the adhesive agent 152. In a case where the adhesive agent 152 is a fast UV curing type, the adhesive agent 152 is irradiated by a stipulated amount of ultraviolet rays through the transparent substrates, and thereafter the adhesive agent 152 is sufficiently hardened by heating the substrates in an oven or the like.

In either case, the adhesive agent 152 is preferably hardened sufficiently in the second bonding process. Specifically, hardening is preferably performed until the hardness of the adhesive agent 152 is 60% or higher, and more particularly 80% or higher. Now, the hardness of the adhesive agent is calculated as follows by a differential scanning calorimeter. Around 1 to 10 mg samples are taken from adhesive agent before hardening and after the second bonding process. The temperature of the samples is raised to 300° C. at a rate of 10° C. per minute, the calorific value (J/g) at this time is measured by the differential scanning calorimeter, and the hardness is calculated from the measured calorific value according to the following expression.

Hardness (%)={(calorific value of adhesive agent before hardening)−(calorific value of adhesive agent after hardening)}/(calorific value of adhesive agent before hardening)

As described above, according to the first bonding process and the second bonding process according to the present embodiment, position can be performed precisely by direct bonding in the first process, and high bonding strength with occurrence of bonding voids and the like suppressed can be obtained by the second process. That is to say, according to the above-described bonding process, high positioning precision and bonding reliability, which were both difficult with direct bonding alone or adhesive agent bonding along, can be achieved.

3. Process of Forming Film

Figure 1H:
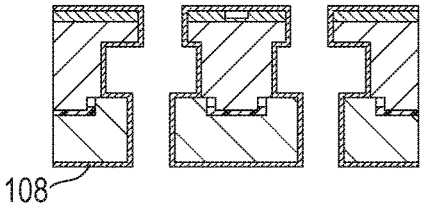
Figure 1I:
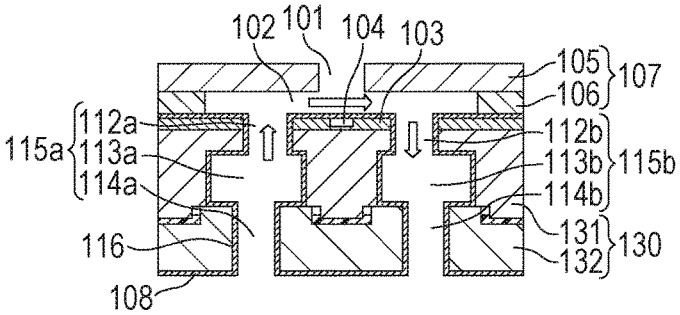
Figure 2C:
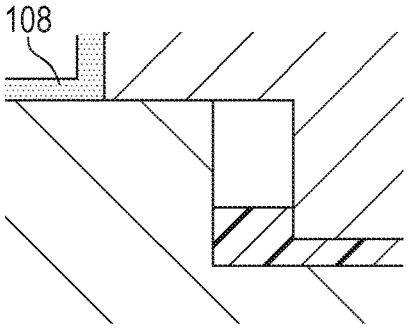

Next, the film 108 having the function of protecting the inner walls of channels from liquid such as ink is formed as necessary, as illustrated in FIGS. 1H and 2C. The inner wall faces of the liquid channels of the liquid discharge head are readily eroded by liquid such as ink or the like, and the channel structure may collapse if exposed to liquid for long periods of time. Particularly, in a case where the substrates are silicon substrates, such damage due to liquid readily occurs. Accordingly, the film 108 is preferably formed on the inner wall faces of the channel 115.

The film 108 is formed over the first substrate 131, second substrate 132, and the bonded portion of the first substrate 131 and second substrate 132 (a bonded portion 153 of the first bonding region 121 and second bonding region 122). Thus, forming the film 108 over the bonded portion 153 enables the bonding reliability between substrates to be improved. Even if slight bonding voids (around 0.1 μm in height) are present within the bonded portion 153 bonded by direct bonding, and a minute path to the adhesive agent 152 is formed from the channel 115, this minute path is easily closed off by the film 108. Accordingly, the adhesive agent 152 can be protected from liquid such as ink or the like even further, and deterioration in adhesion between the substrates due to alteration of the adhesive agent 152 can be suppressed.

The film 108 is preferably formed by atomic layer deposition. A deposition process and an exhaust process are alternately repeated in atomic layer deposition. In the deposition process, precursor molecules serving as the material and water molecules are fed into the substrate in a vacuum chamber, and the substrate surface adsorbs molecules for around one molecule layer worth. At this time, functional groups in the precursor are adsorbed by the hydroxyl groups present on the surface of the substrates. The functional groups rob the hydroxyl groups of hydrogen atoms and break away as volatile molecules. Thereafter, the remaining oxygen atoms and inorganic elements within the precursor are bonded by covalent bonding. In the exhaust process, molecules retained within the chamber without being adsorbed on the surface of the substrates are discharged. A strong bond is formed by covalent bonding in atomic layer deposition, so a film with high adhesion strength can be formed. The mean free path of molecules is great in atomic layer deposition, so groves and holes having high aspect ratios are well covered by the film. Accordingly, the material forming the film finds its way into gaps from the channel side, and a uniform film can be formed on the entire wall within the gap.

On the other hand, depending on the material of the face on which the film is formed, there are cases where the film formed by atomic layer deposition does not have good adhesion with that face. For example, adhesion between the surface of adhesive agent and a film formed by atomic layer deposition is not good, and in a case of the bonded portion 153 being bonded by adhesive agent and the film 108 being formed on the adhesive agent, the film 108 readily peels off. This is because there are few hydroxyl groups as compared to the surface of a substrate formed of a material such as silicon, and the functional groups of the precursor molecules do not readily react. As a result, a great number of unreacted functional groups remain at the interface between the adhesive agent and the film formed by atomic layer deposition, and flaws readily occur. Exposing a bonded-substrate article having such a film to liquid such as ink for prolonged periods can lead to faulty adhesion between the substrates, due to the film formed by atomic layer deposition peeling away and the adhesive agent being altered or liquid intruding into the interface between the adhesive agent and the substrates.

However, according to the present embodiment, the bonded portion 153 is bonded by direct bonding that does not use adhesive agent, so a film 108 with few flaws is strongly bonded to the substrates. As a result, the film 108 does not readily peel off of the inner walls of the channel 115.

The film 108 has liquid-resistant properties and is relatively stable even if exposed to liquid, and functions to protect the adhesive agent and substrates from liquid filled in the channel 115. The film 108 preferably includes an elemental form, an oxide, a nitride, or a carbide, of an element selected from a group made up of tantalum (Ta), titanium (Ti), zirconium (Zr), niobium (Nb), vanadium (V), hafnium (Hf), and silicon (Si). Of these, an oxide of an element selected from the group made up of Ta, Ti, Zr, Nb, V, Hf, and Si is preferably included.

The film 108 may be formed by methods other than atomic layer deposition, as long as gaps are well covered by the film. Examples include chemical vapor deposition (CVD) such as thermal CVD, plasma CVD, catalytic CVD, and so forth. Other methods that can be used include sputtering, vacuum deposition, ion beam deposition, and so forth. These methods are poorer as compared with atomic layer deposition with regard to covering well, but the film formation rate is high, and a film with few impurities, such as carbon, hydrogen, water, and so forth can be formed.

After the process of forming the film 108 has ended, unnecessary portions of the film 108 formed on the bonded-substrate article are removed. An example of an unnecessary portion of the film 108 is a portion formed on electrode pads that are present on the surface of the first substrate 131. The following is an example of a technique that can be used to remove unnecessary portions of the film 108. First, resist that has been formed into a dry film is laminated onto the surface side of the bonded-substrate article, and an etching mask is formed on portions other than the unnecessary portions of the film 108. Thereafter, the unnecessary portions of the film 108 are removed by dry etching or wet etching. After etching, the etching mask is removed by a solvent or the like.

4. Process of Forming Discharge Orifice Forming Member

Next, the discharge orifice forming member 107 is formed on the first substrate 131. First, a dry film resist where photo-setting resin has been coated on a film substrate is adhered onto the first substrate 131. Thereafter, the dry film resist is exposed and developed, thereby patterning the side wall 106 of the discharge orifice forming member 107. Next, the top plate 105 of the discharge orifice forming member 107 is patterned in the same way using dry film resist. Finally, discharge orifices 101 and pressure chambers 102 are formed by developing the unexposed portions, thereby completing the liquid discharge head.

Second Embodiment

Unlike the first embodiment, a second embodiment performs bonding using adhesive agent in the first bonding processing, and not direct bonding. In the present embodiment, a first adhesive agent 151 that hardens at low temperature is coated on at least one of the first bonding region 121 of the first substrate 131 and the third bonding region 123 of the second substrate 132. The first adhesive agent 151 is then hardened at a lower temperature than a second adhesive agent 152 is hardened at in the second bonding process. In the same was as in the first embodiment, the substrates are fixed to each other beforehand at a lower temperature than the second bonding process in the present embodiment, so positional deviation amount the substrates due to stress occurring in the adhesive agent and substrates due to high temperature in the second bonding process does not readily occur.

The manufacturing method of the bonded-substrate article and liquid discharge head according to the present embodiment will be described in order with reference to FIGS. 3A through 4D. Note that points of the present embodiment that differ from the first embodiment will primarily be described, and description of points that are the same as the first embodiment will be omitted.

1. Process for Preparing First Substrate and Second Substrate

Figure 3A:
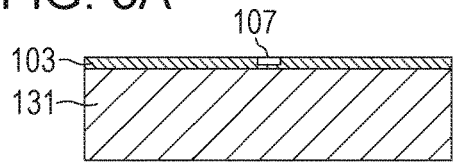
FIGS. 3A through 3J are cross-sectional views illustrating a manufacturing method for a liquid discharge head according to another embodiment of the subject disclosure.
Figure 3B:
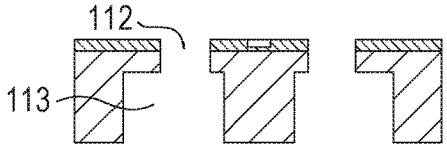
Figure 3C:
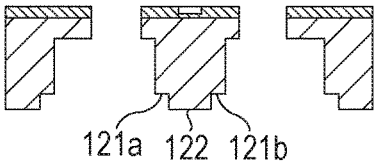
Figure 3D:
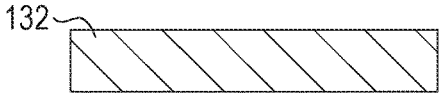
Figure 3E:
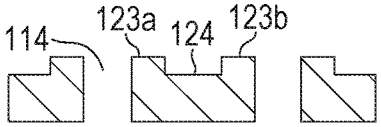

The first substrate 131 is worked to form the first channel 112, second channel 113, first bonding region 121, and second bonding region 122, in the same way as in the first embodiment, as illustrated in FIGS. 3A through 3C. The second substrate 132 also is worked to form the third channel 114, third bonding region 123, and fourth bonding region 124, in the same way as in the first embodiment, as illustrated in FIGS. 3D and 3E. The two substrates are fit and bonded to each other through steps formed on the bonding faces of the substrates in the present embodiment, in the same way as in the first embodiment.

2. Process of Bonding First Substrate and Second Substrate 2-1. Pre-Processing Process The bonding faces may be cleaned and smoothed as necessary, in the same way as in the first embodiment.

2-2. Process of Coating Adhesive Agents

Figure 3F:
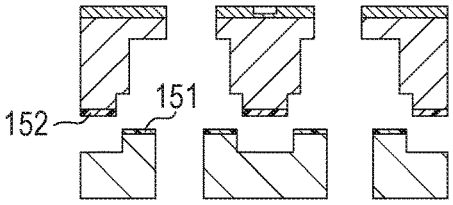
Figure 4A:
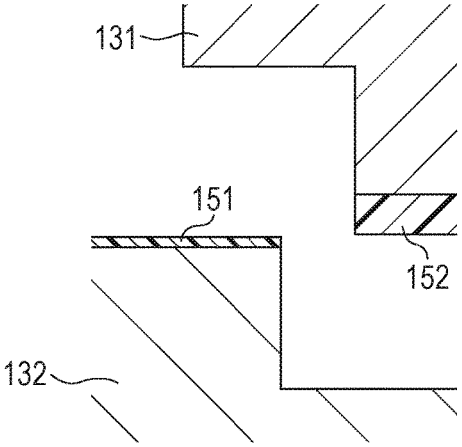
FIGS. 4A through 4D are enlarged cross-sectional views around bonding portions, as part of the manufacturing method for a liquid discharge head according to another embodiment of the subject disclosure.

The first adhesive agent 151 is then coated on at least one of the first bonding region 121 and the third bonding region 123, and the second adhesive agent 152 is coated on at least one of the second bonding region 122 and the fourth bonding region 124, as illustrated in FIGS. 3F and 4A.

Examples of the hardening method of the first adhesive agent 151 include thermosetting and retarded UV curing. In a case where either of the substrates is UV-transmissive, fast UV curing can be used.

The first adhesive agent 151 serves to fix the first substrate 131 and second substrate 132 in the later-described first bonding process, and is an adhesive agent that hardens at a lower temperature than the temperature at which the second adhesive agent 152 used in the second bonding process is hardened at. Further, the first adhesive agent 151 preferably has good removability, since removing at least part in a subsequent process can be expected.

The first adhesive agent 151 preferably includes a resin selected from a group made up of acrylic resin, epoxy resin, cyclized rubber resin, and phenol resin. Adhesive agents including these resins can be hardened at lower temperatures of 50° C. or above to 200° C. or lower, and thus are suitable. The first adhesive agent 151 more preferably includes an alicyclic epoxy resin.

The first adhesive agent 151 preferably is coated on to the third bonding region 123 of the second substrate 132. The third bonding region 123 of the second substrate 132, which is the top face of the recessed form of the bonding face, is preferably coated, from the perspective of ease of coating. The adhesive agent transfer method described in the first embodiment can be used as a coating method. The thickness of the first adhesive agent 151 preferably is as thin as possible from the perspective of improving the positioning precision even further, and specifically, preferably is 2.0 μm or less. Coating the first adhesive agent 151 at a thickness of 2.0 μm or less enables the positional deviation of the substrates in the horizontal direction ΔX and ΔY, and the positional deviation of the substrates in the vertical direction ΔZ, to be suppressed to within 2.0 μm. The thickness of the first adhesive agent 151 is even more preferably 1.0 μm or less since positional deviation can be further suppressed. The second adhesive agent 152 preferably has a certain thickness for fixing the substrates to each other, and specifically is 0.1 μm or more.

The second adhesive agent 152 is an adhesive agent that exhibits a high bonding strength at the bonding portion 154 between the second bonding region 122 and fourth bonding region 124 by being hardened in the second bonding process. An adhesive agent the same as that used in the first embodiment can be used for the second adhesive agent 152.

The second adhesive agent 152 is preferably coated on the second bonding region 122 of the first substrate 131. The second bonding region 122 of the first substrate 131, which is the top face of the protruding portion of the bonding face, is preferably coated, from the perspective of ease of coating. The adhesive agent transfer method, the same as in the first embodiment, can be suitably used. The thickness of the second adhesive agent 152 normally is thicker than the first adhesive agent 151. This is because the second adhesive agent 152 is bonding to guarantee bonding reliability of the substrates, and preferably has a certain thickness, in contrast to the first adhesive agent 151 that preferably is as thin as possible. It is preferable that the thickness of the second adhesive agent 152 specifically is 1.0 μm or more. The reason is that when the thickness of the second adhesive agent 152 is 1.0 μm or more, the adhesive agent can flow and cover any foreign matter, scratches, or surface roughness that might have occurred on the bonding surface, and defective bonding such as voids can be suppressed and a highly-reliable bonding can be obtained. On the other hand, if the thickness of the second adhesive agent 152 is excessively great, the bonding strength of the first adhesive agent 151 can be affected due to the influence of stress, so the thickness of the second adhesive agent 152 preferably is 30.0 μm or less.

2-3. First Bonding Process

Figure 3G:
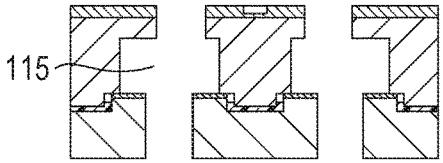
Figure 4C:
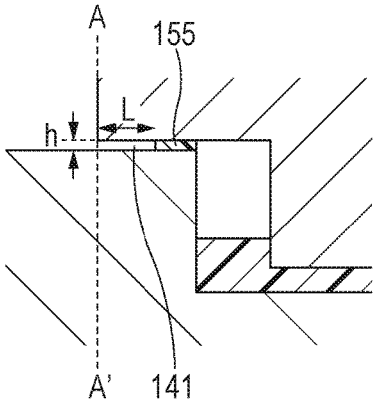
Figure 4B:
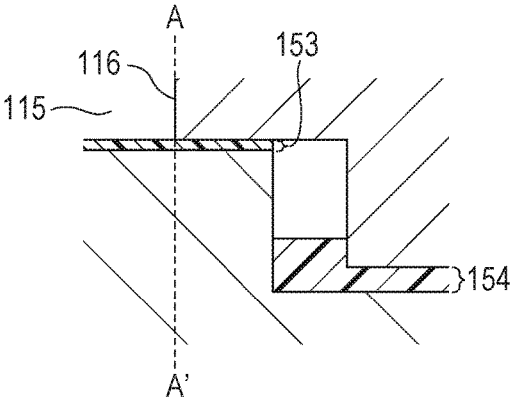

Next, the bonding faces of the substrates are made to face each other, as illustrated in FIGS. 3G and 4B, and aligned with a bonding alignment device or the like, and the first bonding region 121 of the first substrate 131 and the third bonding region 123 of the second substrate 132 are bonded by hardening the first adhesive agent 151. The alignment method described in the first embodiment can be used. After aligning the substrates, the substrates may be transported to a bonding device, heated, and subjected to a predetermined temperature and pressure, for a predetermined amount of time to sufficiently harden the first adhesive agent 151. The first bonding process preferably is performed in a vacuum, to suppress inclusion of bubbles in the adhesive agent interface. The first bonding process preferably is performed under pressure, to suppress thermal expansion when heating and thermal contraction when cooling of the adhesive agent and substrates, thereby suppressing positional deviation of the substrates from each other even further. The temperature at which the first adhesive agent 151 is to be hardened can be appropriately set according to the material of the first adhesive agent 151, but is performed at a temperature lower than the temperature of hardening the second adhesive agent 152 in the second bonding process. Specifically, the temperature at which the first adhesive agent 151 is hardened is 50° C. or above but 200° C. or lower.

2-4. Second Bonding Process

Next, the second bonding region 122 and the fourth bonding region 124 are bonded by hardening the second adhesive agent 152 coated on the second bonding region 122, while still in the bonding device. The role of the bonding portion 154 of the second bonding region 122 and fourth bonding region 124 is to exhibit a high bonding strength, and to guarantee bonding reliability by suppressing occurrence of bonding voids. The second bonding process involves heating at high temperatures to form such a bonding portion 154. Although the temperature depends on the type of second adhesive agent, the heating is performed specifically at a temperature of 100° C. or higher but 300° C. or lower, and more particularly 150° C. or higher but 300° C. or lower.

In the second bonding process, the substrates are heated to a predetermined temperature in the bonding device, and then subjected to a predetermined temperature and pressure, for a predetermined amount of time to sufficiently harden the second adhesive agent 152, in the same way as with the first embodiment. Sufficiently hardening the second adhesive agent 152 in this way increases the adhesion of the bonding portion 154, and a highly-reliable bond can be obtained.

3. Process of Forming Film

Next, the film 108 having the function of protecting the adhesive agent and the inner walls of channels from liquid such as ink is formed as necessary.

3-1. Process of Removing Adhesive Agent

Figure 3H:
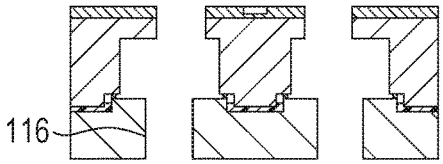

In a case of forming the film 108, the first adhesive agent 151 is preferably removed from the channel side as illustrated in FIG. 3H, before forming the film 108. Specifically, the first adhesive agent 151 that has gone past an edge face A-A' at the bonded portion 153 of the first substrate 131 and second substrate 132 into the channel 115 is removed from the channel 115 side, as illustrated in FIG. 4C. The first adhesive agent 151 is removed at this time so that an edge portion 155 of the first adhesive agent 151 is caused to regress to a position from the edge face A-A' toward the inner side of the bonded-substrate article 130. Accordingly, the film 108 can be formed to close off a gap 141 formed between the first substrate 131 and second substrate 132, and intrusion of liquid such as ink or the like to the bonding interface can be markedly suppressed. Note that the gap 141 is a space is made up of at least the bonding face of the first substrate 131, the bonding face of the second substrate 132, and the edge portion 155 of the first adhesive agent 151 having an opening at the edge face A-A' of the bonded portion 153.

Examples of techniques to remove the first adhesive agent 151 and cause the edge portion 155 of the adhesive agent to regress include oxygen plasma ashing and etching. When removing by ashing, first, the bonded-substrate article is placed in an ashing chamber, and oxygen ions and oxygen radicals are generated by high-frequency plasma while applying a flow of oxygen gas. The oxygen ions and oxygen radicals intrude into the channel from the opening portion of the first channel and the third channel of the bonded-substrate article. The oxygen ions and oxygen radicals in the channel only slightly oxidize the surface of substrate materials such as silicon or the like, but react with the carbon that is the primary component of the adhesive agent and causes it to volatilize, so the adhesive agent is isotopically removed.

An example of removal by etching is wet etching. In this case, the adhesive agent is etched by immersing the bonded-substrate article in an etchant. An appropriate etchant is selected in accordance with the type of adhesive agent. Examples of the etchant in a case where the adhesive agent includes epoxy resin include concentrated sulfuric acid, chromic acid, and alkaline permanganate. The etchant in a case where the adhesive agent includes polyimide resin is preferably an alkaline aqueous solution, examples thereof including hydrazine, caustic alkali, and organic amine compounds.

The regression width L of the edge portion 155 of the adhesive agent from the edge face A-A' of the bonded portion 153 can be decided as appropriate. Setting the regression width L to be great enables a contact width W (see FIG. 4D) of the film 108 formed in alter-described process as to the first bonding region 121 within the gap 141 to be made larger, so the adhesion of the film 108 within the gap 141 can be increased, and reliability regarding liquid-resistant properties to counter erosion by liquid such as ink or the like can be improved. Specifically, the regression width L and the height h of the gap 141 preferably satisfy a relation of $h<L$. More specifically, the regression width L preferably is 0.02 μm or greater but 200 μm or less, further preferably is 0.2 μm or greater but 200 μm or less, and more particularly preferably is 2 μm or greater but 20 μm or less. The first adhesive agent 151 may be completely removed.

3-2. Process of Forming Film

Figure 3I:
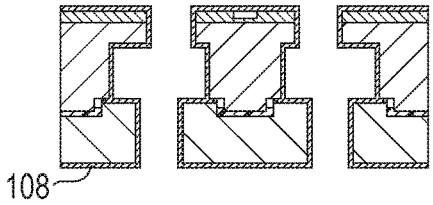
Figure 4D:
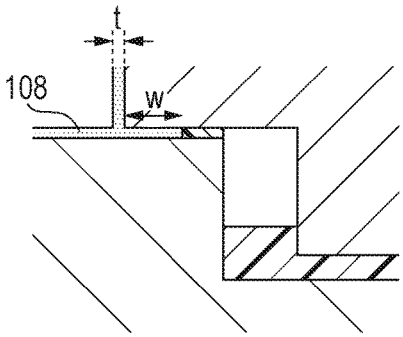

Next, the film 108 is formed from the first substrate 131 to the second substrate 132 on the inner wall face of the channel 115, as illustrated in FIGS. 3I and 4D. The film 108 preferably is formed so as to close off the gap 141. The term "forming the film so as to close off the gap" means that the film is formed in the gap, and when viewed form the channel side, the gap is in a state of having been filled in by the film.

The materials and film forming methods listed in the first embodiment can be used for formation of the film 108. The film 108 starts adhering to the bonding face of the first substrate 131 and the bonding face of the second substrate 132 within the gap 141, and eventually these films become one, thereby closing off the gap 141. At this time, the film 108 almost completely fills the gap 141 and becomes one. In order to sufficiently fill in the gap 141, the thickness t of the film 108 and the height h of the gap 141 preferably satisfies the relation of $h<t$. In the present embodiment, positional deviation in the vertical direction of the substrates is suppressed by the above-described two-sage bonding process, so the height of the gap 141 formed in the above process of removing the adhesive agent can be strictly controlled. As a result, the amount of film formation of the film 108 necessary to close off the gap 141 in this process of forming the film 108 can be accurately predicted, and a liquid discharge head having a uniform film 108 in the channel can be easily manufactured.

4. Process of Forming Discharge Orifice Forming Member

Next, the side wall 106 and top plate 105 of the discharge orifice forming member 107 are formed on the first substrate 131 in the same way as in the first embodiment, and the liquid discharge head is complete.

Other Embodiments

An arrangement where the bonding face of the first substrate 131 is a protruding form and the bonding face of the second substrate 132 is a recessed form has been described in the above-described two embodiments, but an arrangement may be made where the bonding face of the first substrate 131 is a recessed form and the bonding face of the second substrate 132 is a protruding form. However, in a case where the bonding face of the first substrate 131 (rear side) has a larger area than the bonding face of the second substrate 132 (front side), as in the above embodiments, the recessed form is preferably formed on the second substrate 132 side that has a wider bonding face. The reason is that the narrower the width of the bonding face is, the more difficult it is to continuously cover with resist uniformly from the edge of the bonding face, and forming the resist for forming the recessed portion is difficult. Particularly, in a case of a liquid discharge head having the shape illustrated in FIGS. 1I and 3J, the width on the rear face of the first substrate 131 immediately below the energy generating element 104 is extremely narrow, so the first substrate 131 side preferably has a protruding form.

Although a step has been provided between the first bonding region 121 and second bonding region 122 in the first substrate 131 in the above-described two embodiments, two bonding regions may be provided on the same plane. Particularly, in the second embodiment, the first bonding region 121 and second bonding region 122 are both bonded to the second substrate 132 by adhesive agent, so the two bonding regions may be on the same plane, as long as the thickness of the adhesive agent is maximally matched. On the other hand, in the first embodiment, the first bonding region 121 is bonded to the second substrate 132 by direct bonding, while the second bonding region 122 is bonded to the second substrate 132 by adhesive agent. Accordingly, a step of a size at least equivalent to the thickness of the adhesive agent is preferably provided between the first bonding region 121 and second bonding region 122.

Also, in the above-described two embodiments, the first bonding region 121 that is bonded in the first bonding process is provided at the channel side, and the second bonding region 122 bonded in the second bonding process is provided on the inner side of the bonded-substrate article 130. However, the positions of the first bonding region 121 and second bonding region 122 may be inverted, and the bonding regions on the inner side of the bonded-substrate article 130 may be bonded first in the first bonding process.

Figure 3J:
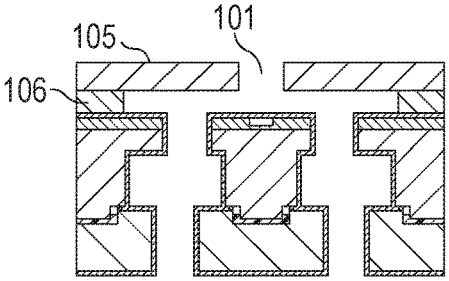

Although the liquid discharge head in the above-described two embodiments is a bonded article of substrates having channels, this is not restrictive. The bonded-substrate article according to the present embodiment can be applied to a bonded article of substrates at any position within a liquid discharge head. For example, in a case where the discharge orifice forming member is formed by two or more substrates being bonded, the above-described bonded-substrate article can be applied to the discharge orifice forming member. A case where the discharge orifice forming member is formed by two or more substrates being bonded is a case where the discharge orifice forming member 107 is configured of the top plate 105 forming the discharge orifice 101, and the side wall 106 forming the pressure chamber 102, as illustrated in FIGS. 1I and 3J, for example. Also, the bonded-substrate article according to the present disclosure can be applied to a bonded article of at least one substrate having a discharge orifice forming member and a substrate having an energy generating element.

EXAMPLES

Example 1

A liquid discharge head was fabricated using the method illustrated in FIGS. 1A through 1I. First, a silicon substrate with 730 μm in thickness and an 8-inch diameter was prepared as the first substrate 131, as illustrated in FIG. 1A. On the front face (mirror face) of the first substrate 131 were formed aluminum wiring, an inter-layer insulating film of a thin film of silicon oxide, a heater thin-film pattern of tantalum nitride, and contact pads to conduct with an external control unit, by a photolithography process. UV curing tape, 180 μm thick, was applied to the front face of the first substrate 131 as a protective tape, and the rear face of the first substrate 131 was ground by a grinding device to reduce the thickness of the substrate, until the thickness of the substrate was 500 μm. Thereafter, the ground face was polished by a CMP device to smooth the face. The CMP device was used to perform primary polishing as coarse polishing, and secondary polishing as fine polishing. The polishing was performed using a slurry of which the primary component was colloidal silica. A polyurethane polishing pad was used as the polishing pad for the primary polishing, and a suede polishing pad was used for the secondary polishing. The rear face of the first substrate 131 was polished in the primary polishing until the surface coarseness was 0.2 nm. After polishing, the polished face was cleaned with a cleaning fluid that was a mixture of 8% by weight of ammonia, 8% by weight of a hydrogen peroxide solution, and 84% by weight of pure water, thereby removing the slurry.

Next, a mask was formed to form the first bonding region 121 and second bonding region 122 on the rear face side of the first substrate 131. First, a polyamide resin solution (product name HIMAL, manufactured by Hitachi Chemical Company, Ltd.) was coated on the entire rear face of the first substrate 131 to a thickness of 2.0 μm by spin coating, and hardened by thermal treatment at 250° C. for one hour. Thereafter a novolak resist was coated thereupon, and the resist was patterned by exposing by a two-sided alignment exposing device, and developing by a developing device. Dry etching was performed over the resist using plasma discharging into $O_2$ gas and $CF_4$ gas, thereby working the mask to a desired form. After etching, the resist was removed, completing the mask. Further, a mask for shaping the second channel 113 was from on the mask for forming the first bonding region 121 and second bonding region 122 on the rear face of the first substrate 131.

Next, a groove to serve as the second channel 113 was formed by etching, as illustrated in FIG. 1B. The Bosch process, where etching by $SF_6$ gas and deposition by $CF_4$ gas is repeated, was used for the etching. The etching was stopped at the point that the e average groove depth was 300 μm. After removing the protective tape by irradiation by ultraviolet rays, the resist and etching deposits were removed using a stripping solution of which the primary component was hydroxylamine.

Protective tape was then applied to the rear face of the first substrate 131 and a mask was formed on the front face in the same was as described above, and the first channel 112 made up of multiple holes was formed by dry etching from the front face side of the substrate. After etching, the protective tape was removed, and resist and deposits were removed by a stripping solution.

Following this, a protruding form to serve as the first bonding region 121 and second bonding region 122 was formed, as illustrated in FIG. 1C. First, the surface of the first substrate 131 was laminated by a protective tape again. Silicon anisotropic etching by $SF_6$ plasma was performed over the mask already formed on the rear face side to a depth of 10 μm, working the junction face into a protruding form. Thereafter, the mask was removed by ashing using oxygen plasma.

Next, a silicon substrate 500 μm thick was prepared as the second substrate 132, as illustrated in FIG. 1D.

A mask was then formed on the front side (mirror face) of the second substrate 132, silicon anisotropic etching by $SF_6$ plasma was performed to a depth of 11 μm, working the bonding face into a recessed form. Further, a protective film was applied to the front face side of the second substrate 132, a mask was formed on the rear face, and the third channel 114 was formed by the Bosch process. Thereafter, the protective film was peeled away, and resin and deposits were removed by a stripping solution.

As a pre-preparation to the bonding process, the rear face of the first substrate 131 and the front face of the second substrate 132 were cleaned. Cleaning was performed by combined use of a cleaning fluid that was a mixture of 8% by weight of ammonia, 8% by weight of a hydrogen peroxide solution, and 84% by weight of pure water, and an ultrasonic vibrator. Further, as pre-preparation to the direct bonding, the rear face of the first substrate 131 and the front face of the second substrate 132 were subjected to irradiation, by $N_2$ plasma in a vacuum, using a radio frequency (RF) discharge device. The plasma power was 100 W, and the irradiation time was 30 seconds.

Next, the adhesive agent 152 was coated on the second bonding region 122 on the rear face of the first substrate 131, as illustrated in FIG. 1F. First, an 8-inch silicon substrate was prepared as a transfer substrate, and a benzocyclobutene resin solution (product name CYCLOTENE, manufactured by Dow Chemical Company) was applied by spin coating to a thickness of 1 μm, as the adhesive agent 152. Thereafter, the second bonding region 122 of the first substrate 131 was brought into contact with the second adhesive agent 152 that had been coated, thereby transferring the adhesive agent 152 onto the rear face of the first substrate 131.

Next, for alignment of the first substrate 131 and second substrate 132 using a bonding alignment device, two positions at the substrate ends were temporarily fixed by pressurizing using a clamp jig. Minute spacer jigs, 5 mm long and 200 μm thick, were inserted to multiple positions on the perimeter portion of the substrates until implementing direct bonding, so that the first substrate 131 and second substrate 132 would not come into contact and direct bonding start.

The temporarily fixed substrates where then transported into a bonding device which was then drawn to a vacuum, and the first bonding region 121 and third bonding region 123 were brought into contact by pressurizing at room temperature, and bonded by plasma activated bonding (first bonding process), as illustrated in FIG. 1G. The substrates where then heated to 250° C. inside the bonding device, and the adhesive agent 152 was hardened by maintaining 250° C. for one hour with the substrates under pressure (second bonding process). Thereafter, the bonded-substrate article was cooled and removed from the bonding device.

Next, the film 108 was formed on the inner wall faces of the channels of the bonded-substrate article 130 as illustrated in FIG. 1H, by atomic layer deposition. The film 108 was a TiO film, and the thickness of the film 108 was 0.2 μm.

Next, dry film resist configured of a positive resist was laminated onto the front face of the first substrate 131 of the bonded-substrate article 130, forming a mask. Unnecessary film 108 on contact pads was removed by dry etching using plasma from a gas mixture of $CF_4$, $O_2$, and Ar.

Next, the discharge orifice forming member 107 was formed, as illustrated in FIG. 1I. A negative dry film formed of epoxy resin was applied to the front face of the first substrate 131, and exposed, thereby forming the side wall 106 of the discharge orifice forming member 107. Further, a similar dry film was applied thereupon, and exposed, thereby forming the top plate 105 of the discharge orifice forming member 107. Unexposed portions of the dry film were removed simultaneously be developing, thereby forming the discharge orifice 101 and pressure chamber 102. Thereafter, thermal treatment was performed in an oven at 200° C. for one hour, thereby hardening the discharge orifice forming member 107. The liquid discharge head was thus fabricated.

Example 2

A liquid discharge head was fabricated using the method illustrated in FIGS. 3A through 3J. First, the first substrate 131 was fabricated in the same way as in Example 1, as illustrated in FIGS. 3A through 3C. The second substrate 132 was also fabricated in the same way as in Example 1, as illustrated in FIGS. 3D and 3E.

Next, the first adhesive agent 151 was coated onto the third bonding region 123 of the second substrate 132, and the second adhesive agent 152 onto the second bonding region 122 of the first substrate 131, as illustrated in FIG. 3F. The first adhesive agent 151 was a thermosetting adhesive agent of which the primary component was an alicyclic epoxy resin, and was coated onto a transferring substrate to a thickness of 1 μm by spin coating, and transferred onto the second substrate 132 so as to coat the second substrate 132, in the same way as in Example 1. For the second adhesive agent 152, a transferring substrate was covered by benzocyclobutene resin solution to a thickness of 2.5 μm, and transferred onto the first substrate 131 so as to coat the first substrate 131, in the same way as in Example 1.

Next, the first substrate 131 and second substrate 132 were aligned and temporarily fixed, in the same way as in Example 1. The fixed substrates were transported into a bonding device, pressurized for 30 minutes at 70° C. in a vacuum, and thereafter pressurized for 20 minutes at 130° C., thereby hardening the first adhesive agent 151 (first bonding process), as illustrated in FIG. 3G. The substrates where then heated to 250° C. and pressurized for one hour, thereby hardening the second adhesive agent 152 (second bonding process). Thereafter, the bonded-substrate article 130 was cooled and removed from the bonding device.

The first adhesive agent 151 exposed at the inner wall faces of the channel was etched in an etching device, as illustrated in FIG. 3H. The regression width L of the edge portion 155 of the first adhesive agent 151 was 5.0 μm from the edge face A-A' of the bonded portion 153.

Next, the film 108 was formed on the inner walls of the channels of the bonded-substrate article 130 by atomic deposition layering, as illustrated in FIG. 3I. The film 108 was a TiO film, and the thickness of the film 108 was 0.3 μm.

Finally, the discharge orifice forming member 107 was formed in the same way as in Example 1, as illustrated in FIG. 3J, thereby fabricating the liquid discharge head.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-114250 filed Jun. 9, 2017, which is hereby incorporated by reference herein in its entirety.

What is claimed is:

1. A manufacturing method for a bonded-substrate article where a first substrate has a first bonding region and a second bonding region that are both bonded to a second substrate, and the second substrate has a third bonding region and a fourth bonding region that are both bonded to the first substrate, the method comprising:

first bonding, where the first bonding region of the first substrate and the third bonding region of the second substrate are bonded at a first temperature; and second bonding, following the first bonding, where the second bonding region of the first substrate and the fourth bonding region of the second substrate are bonded at a second temperature, wherein the first temperature is lower than the second temperature.

2. The manufacturing method of a bonded-substrate article according to claim 1, further comprising:

coating an adhesive agent onto at least one of the second bonding region of the first substrate and the fourth bonding region of the second substrate, wherein the adhesive agent is hardened in the second bonding.

3. The manufacturing method of a bonded-substrate article according to claim 2, wherein the first substrate has a step between a face that forms the first bonding region and a face that forms the second bonding region, the second substrate has a step between a face that forms the third bonding region and a face that forms the fourth bonding region, and the first substrate and second substrate are fit to each other at the steps of each other.

4. The manufacturing method of a bonded-substrate article according to claim 3, wherein the face forming the second bonding region of the first substrate is at a position protruding further than the face forming the first bonding region, along a direction in which the first substrate and the second substrate are bonded, wherein the face forming the fourth bonding region of the second substrate is at a position further recessed than the face forming the third bonding region, along the direction in which the first substrate and the second substrate are bonded, and wherein the adhesive agent that is hardened in the second bonding is coated on the second bonding region.

5. The manufacturing method of a bonded-substrate article according to claim 1, wherein, in the first bonding, the first bonding region of the first substrate and the third bonding region of the second substrate are bonded by direct bonding.

6. The manufacturing method of a bonded-substrate article according to claim 5, wherein the direct bonding is plasma activated bonding or room-temperature bonding.

7. The manufacturing method of a bonded-substrate article according to claim 1, further comprising:

coating the adhesive agent on at least one of the first bonding region of the first substrate and the third bonding region of the second substrate, and wherein the adhesive agent is hardened in the first bonding.

8. The manufacturing method of a bonded-substrate article according to claim 1, wherein the second bonding is performed at a temperature of 100° C. or higher.

9. The manufacturing method of a bonded-substrate article according to claim 1, wherein the first bonding is performed at a temperature of 200° C. or lower.

10. A manufacturing method for a liquid discharge head having a bonded-substrate article where a first substrate has a first bonding region and a second bonding region that are both bonded to a second substrate, and the second substrate has a third bonding region and a fourth bonding region that are both bonded to the first substrate, and the bonded-substrate article has a liquid channel traversing the first substrate and the second substrate, the method comprising:

first bonding, where the first bonding region of the first substrate and the third bonding region of the second substrate are bonded at a first temperature; and second bonding, following the first bonding, where the second bonding region of the first substrate and the fourth bonding region of the second substrate are bonded at a second temperature, wherein the first temperature is lower than the second temperature.

11. The manufacturing method of a liquid discharge head according to claim 10, further comprising:

coating an adhesive agent onto at least one of the second bonding region of the first substrate and the fourth bonding region of the second substrate, wherein the adhesive agent is hardened in the second bonding.

12. The manufacturing method of a liquid discharge head according to claim 11, wherein the first substrate has a step between a face that forms the first bonding region and a face that forms the second bonding region, the second substrate has a step between a face that forms the third bonding region and a face that forms the fourth bonding region, and the first substrate and second substrate are fit to each other via the steps of each other.

13. The manufacturing method of a liquid discharge head according to claim 12, wherein the face forming the second bonding region of the first substrate is at a position protruding further than the face forming the first bonding region, along a direction in which the first substrate and the second substrate are bonded, wherein the face forming the fourth bonding region of the second substrate is at a position further recessed than the face forming the third bonding region, along the direction in which the first substrate and the second substrate are bonded, and wherein the adhesive agent that is hardened in the second bonding is coated on the third bonding region.

14. The manufacturing method of a liquid discharge head according to claim 10, wherein the first bonding region and second bonding region of the first substrate are provided in order in a direction from an inner wall traversing the first substrate and second substrate toward an inner portion of the bonded-substrate article.

15. The manufacturing method of a liquid discharge head according to claim 10, wherein, in the first bonding, the first bonding region of the first substrate and the third bonding region of the second substrate are bonded by direct bonding.

16. The manufacturing method of a liquid discharge head according to claim 15, wherein the direct bonding is plasma activated bonding or room-temperature bonding.

17. A bonded-substrate article, comprising:

a first substrate;

a second substrate;

wherein the first substrate has a first bonding region and a second bonding region that are both bonded to the second substrate, and the second substrate has a third bonding region and a fourth bonding region that are both bonded to the first substrate, and, wherein the first bonding region of the first substrate and the third bonding region of the second substrate are directly in contact with each other to form a direct bonding region, and the second bonding region of the first substrate and the fourth bonding region of the second substrate are bonded to each other, with an adhesive applied therebetween, to form an adhesive bonding region.

18. The bonded-substrate article according to claim 17, wherein the first substrate has a step between a face that forms the first bonding region and a face that forms the second bonding region, the second substrate has a step between a face that forms the third bonding region and a face that forms the fourth bonding region, and the step of the first substrate and the step of the second substrate are fit to each other.

19. A liquid discharge head, comprising:

a discharge orifice forming member that includes a discharge orifice, a bonded-substrate article where a first substrate and a second substrate are bonded to each other, and the bonded-substrate article has a liquid channel provided traversing the first substrate and the second substrate, and a side wall that connects the discharge orifice forming member to the bonded-substrate article, wherein the bonded-substrate article is the bonded-substrate article according to claim 17.

20. The liquid discharge head according to claim 19, wherein the first bonding region and second bonding region of the first substrate are provided in order in a direction from an inner wall of the channel traversing the first substrate and second substrate toward an inner portion of the bonded-substrate article.

* * * * *